US008359711B2

(12) United States Patent
Isley

(10) Patent No.: US 8,359,711 B2
(45) Date of Patent: Jan. 29, 2013

(54) RESTRICTING DEVICES FOR A WINDOW HINGE

(75) Inventor: David Andrew Isley, Gloucestershire (GB)

(73) Assignee: Securistyle Limited, Cheltenham, Gloucestershire (GB)

( * ) Notice: Subject to any disclaimer, the term of this patent is extended or adjusted under 35 U.S.C. 154(b) by 109 days.

(21) Appl. No.: 12/531,821

(22) PCT Filed: Mar. 19, 2008

(86) PCT No.: PCT/GB2008/000974

§ 371 (c)(1),
(2), (4) Date: Sep. 17, 2009

(87) PCT Pub. No.: WO2008/114014

PCT Pub. Date: Sep. 25, 2008

(65) Prior Publication Data

US 2010/0071269 A1 Mar. 25, 2010

(30) Foreign Application Priority Data

Mar. 20, 2007 (GB) ..... 0705314.3

(51) Int. Cl.
*E05D 15/00* (2006.01)

(52) U.S. Cl. ..... 16/362; 16/363; 16/193

(58) Field of Classification Search ..... 16/193, 16/197, DIG. 16, 362, 363, 366, 370, 371; 49/445, 446, 447, 181, 193, 197, 198, 200, 49/187

See application file for complete search history.

(56) References Cited

U.S. PATENT DOCUMENTS

| | | | | | |
|---|---|---|---|---|---|
| 2,784,459 | A * | 3/1957 | Anderberg et al. | ..... | 49/248 |
| 3,722,142 | A * | 3/1973 | Anderberg et al. | ..... | 49/248 |
| 3,788,006 | A * | 1/1974 | Teggelaar et al. | ..... | 49/417 |
| 4,015,367 | A * | 4/1977 | DeBruyn | ..... | 49/451 |
| 4,102,012 | A * | 7/1978 | Davis | ..... | 16/344 |
| 4,506,478 | A * | 3/1985 | Anderson | ..... | 49/181 |
| 5,632,117 | A * | 5/1997 | Prete et al. | ..... | 49/181 |
| 6,088,880 | A * | 7/2000 | LaSee | ..... | 16/366 |
| 6,990,710 | B2 * | 1/2006 | Kunz et al. | ..... | 16/193 |
| 2005/0193631 | A1 * | 9/2005 | Marshik et al. | ..... | 49/183 |

FOREIGN PATENT DOCUMENTS

| | | | |
|---|---|---|---|
| GB | 2295645 | | 6/1996 |
| GB | 2307944 | | 6/1997 |
| GB | 2311324 | | 9/1997 |
| GB | 2330173 | | 4/1999 |
| GB | 2333122 | | 7/1999 |
| GB | 2348462 | | 10/2000 |
| GB | 2425150 | | 10/2006 |
| GB | 2427650 | | 1/2007 |
| JP | 2005139653 | A * | 6/2005 |
| JP | 2005139852 | A * | 6/2005 |

* cited by examiner

*Primary Examiner* — Chuck Y. Mah
(74) *Attorney, Agent, or Firm* — Carl M. Napolitano; GrayRobinson, P.A.

(57) ABSTRACT

A slider for use in a track having an end stop therein, the slider having a detent therein and including a releasable restrictor having a rib thereon, wherein the releasable restrictor can be held in an active position by an interaction between the rib and the detent, or an inactive position, and wherein the releasable restrictor is automatically reset in its active position when the slider reaches the end stop in the track. More controlled closing of a window sash is thereby possible.

21 Claims, 5 Drawing Sheets

RESTRICTING DEVICES FOR A WINDOW HINGE

CROSS-REFERENCE TO RELATED APPLICATION

This application claims priority to PCT International Application No. PCT/GB2008/000974, filed 19 Mar. 2008, which itself claims priority to GB 0705314.3 filed on 20 Mar. 2007, the disclosures of which are herein incorporated by reference in its entirety, and all commonly owned.

FIELD OF INVENTION

The present invention relates to restricting devices. More particularly, the present invention relates to a slider incorporating a restrictor and a restricting device incorporating such a slider.

BACKGROUND

It is well known to use sliders in tracks in the window industry. Many window hinges incorporate links of various kinds mounted to a track using at least one slider which can move along the track.

Restricting devices are also known for limiting the opening of a vent, such as a window, to prevent the window sash from being blown fully open in high winds. Such restricting devices allow a user to open a window a certain amount by allowing a slider in a track to engage at a certain location along the track. Such restricting devices, however, do not prevent the window sash from being blown fully closed, which can cause damage to the window sash, window frame or window furniture.

In view of the foregoing, there is clearly a need for a device to control the closing of a window from an open position in a practical manner, which also allows a user to readily close the window in a simple fashion when required.

SUMMARY

Accordingly, the present invention provides a slider for use in a track, the slider comprising a releasable restrictor, wherein the releasable restrictor can be held by the slider in an active position or an inactive position, and wherein the releasable restrictor is automatically reset in its active position when the slider reaches an end stop in a track.

Such a slider allows for the releasable restrictor to be set in an inactive position by a user for closing of a window, for example, yet automatically reactivates the restrictor following closing such that full motion of the slider along the track is restricted.

Preferably the releasable restrictor is held in its active position by a detent on the slider. The detent may interact with a rib on the restrictor. In a particular embodiment, the detent may be a spring clip or other resilient device.

Preferably, as the rib part is moved over the detent, the restrictor moves between its active and inactive positions.

The restrictor is preferably continuously biased into its active position. A leaf spring may achieve this function, although other forms of device can alternatively be used, where appropriate.

In a specific embodiment, the restrictor pivots between its active and inactive positions. Longitudinal motion of the restrictor is also preferably involved and, if this is the case, the restrictor is preferably carried in a cradle and moves within the cradle between its active and inactive positions.

The restrictor preferably includes a tongue which, when in use, retains the restrictor in its inactive position. More preferably, the tongue, in use, engages the cradle to retain the restrictor in its inactive position.

An end stop preferably engages the tongue of the restrictor to automatically reset the restrictor in its active position. The end stop may comprise an abutment and a flange which enters the cradle to engage the tongue of the restrictor. Other appropriate arrangements can, of course, alternatively be envisaged.

The restrictor preferably includes means for engaging a track, in use, to restrict the motion of the slider along the track. More particularly, the engagement means may be shaped to restrict motion of the slider in one direction and to allow motion of the slider in the other direction along a track, during use.

In a particular embodiment, the engagement means comprise ears on the restrictor, the ears each having a substantially perpendicular first side and a ramped second side.

The present invention further provides a restricting device comprising a track, a link and a slider as described and claimed herein, wherein the link is attached to the slider and the slider is accommodated in the track. In such a device, the track preferably includes a plurality of cut outs for receiving the restrictor. More particularly, the track preferably has a base and two side walls with inwardly facing flanges, the cut outs being formed in the inwardly facing flanges. In another embodiment (not shown), cut outs might be formed in the side walls.

According to a further aspect of the present invention, there is provided a restricting device wherein the device can be opened or closed fully when the restrictor is in its inactive position, but only closes to a first restricted position when the restrictor is in its active position.

BRIEF DESCRIPTION OF DRAWINGS

A specific embodiment of the present invention is now described, by way of example only, with reference to the accompanying drawings, in which.

DETAILED DESCRIPTION OF PREFERRED EMBODIMENT

Figure 1:
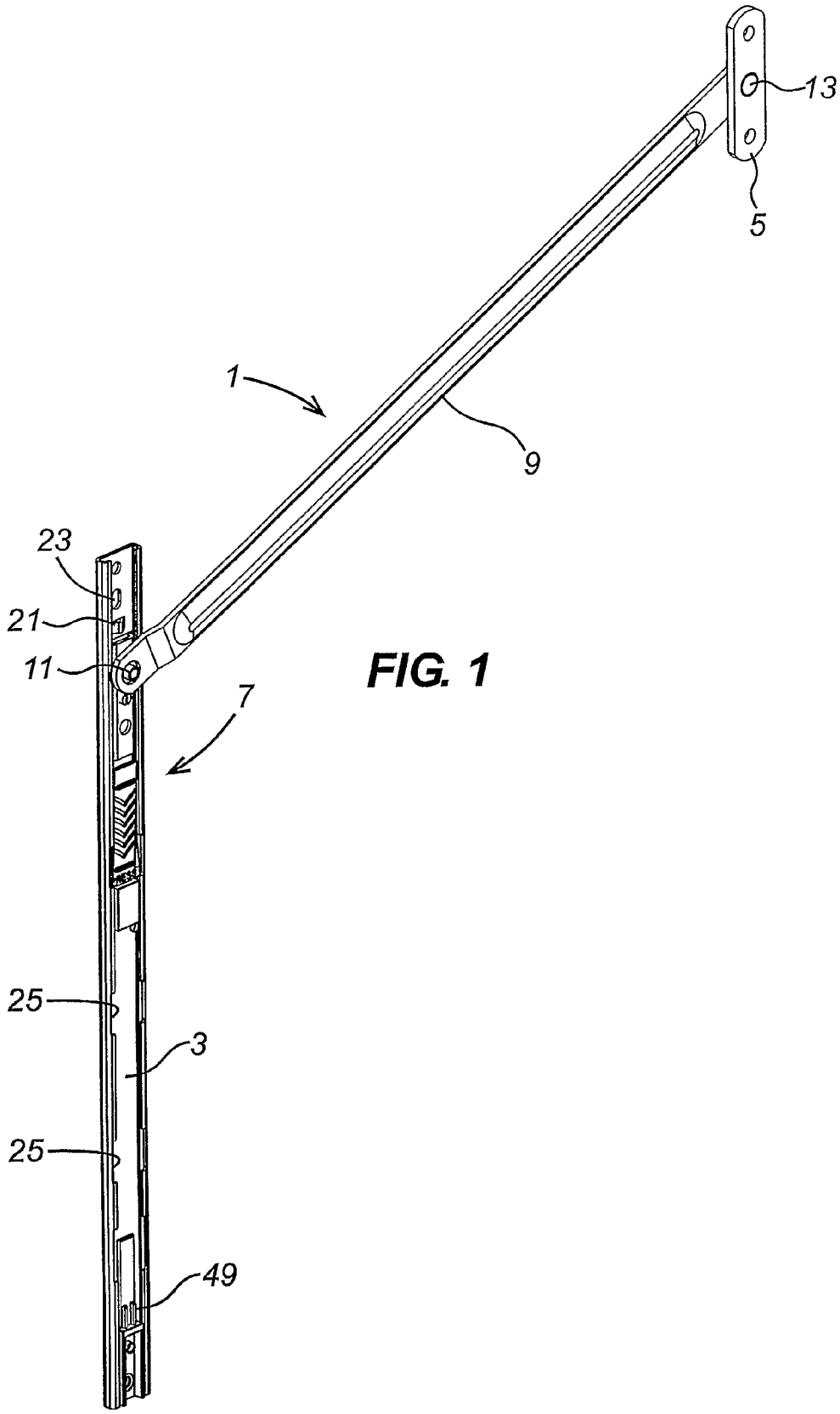
FIG. 1 is a perspective view of a restricting device according to the present invention in a fully open position.

Turning now to the drawings, FIG. 1 shows a restricting device 1 according to the present invention for restricting the motion of a window sash, for example. The restricting device 1 includes a track 3 for attachment to a fixed frame of a building (not shown), a mounting flange 5 for attachment to a window sash, for example, a slider 7 within the track 3 and a link 9 for connecting the slider 7 to the mounting plate 5. The link 9 is connected by pivots 11, 13 to the slider 7 and the mounting plate 5 respectively.

Figure 2:
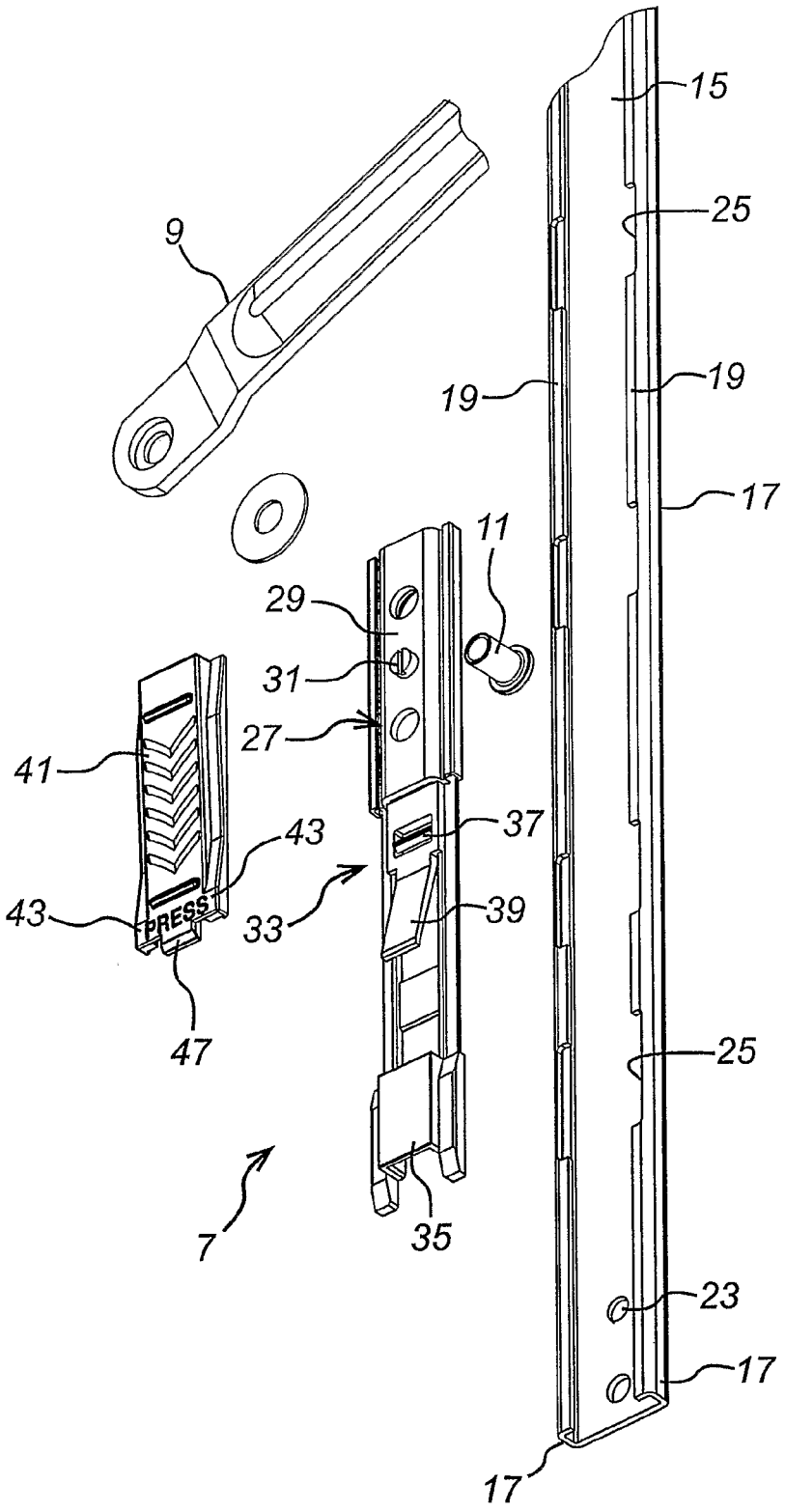
FIG. 2 is an exploded view of FIG. 1 showing the area around a slider according to the present invention.

As can be seen more clearly in FIG. 2, the track 3 comprises a base 15 and two 20 upstanding side walls 17 having inwardly facing flanges 19. The shape of this track 3 is the well known C-shaped cross-sectional track used in many window hinges and other window furniture. As can be seen in FIGS. 1 and 2, the track 3 includes a track stop 21 for limiting the motion of the slider 7 out of the track 3 and some fixing holes 23 in the base 15 of the track for receiving means for fastening the track 3 to a fixed frame of a 25 building. A number of cut outs 25 are also formed in the flanges 19 of the track 3.

The slider 7 itself includes a body portion 27 for mounting the link 9. The body portion 27 has a metal body 29 with a plastics skin (not shown) between the track 3 and the body portion 27. A grub screw 31 is threadedly received by the body 29 to urge the plastics skin away from the body 29 into contact with the track 3, thereby adjusting the friction between the slider 7 and the track 3.

The body portion 27 extends into a cradle 33 and terminates in a tunnel portion 35. The cradle 33 accommodates a spring clip 37 and a steel spring 39 and receives a restrictor 41. The restrictor 41 is designed to rock or pivot within the cradle and to slide forward and backwards along the cradle 33.

As will be appreciated, the slider 7, including the restrictor 41, is shaped to be received within the track 3 and retained therein by virtue of the inwardly facing flanges 19. The restrictor 41 includes ears 43 for engaging in the cut outs 25 in the flanges 19 of the track 3. These ears 43 include a flat surface which acts to prevent closing of the restricting device and ramped surfaces for allowing opening of the restricting device 1 by allowing the ears to move beneath the flanges 19 of the track 3 as the slider 7 moves.

Figure 3:
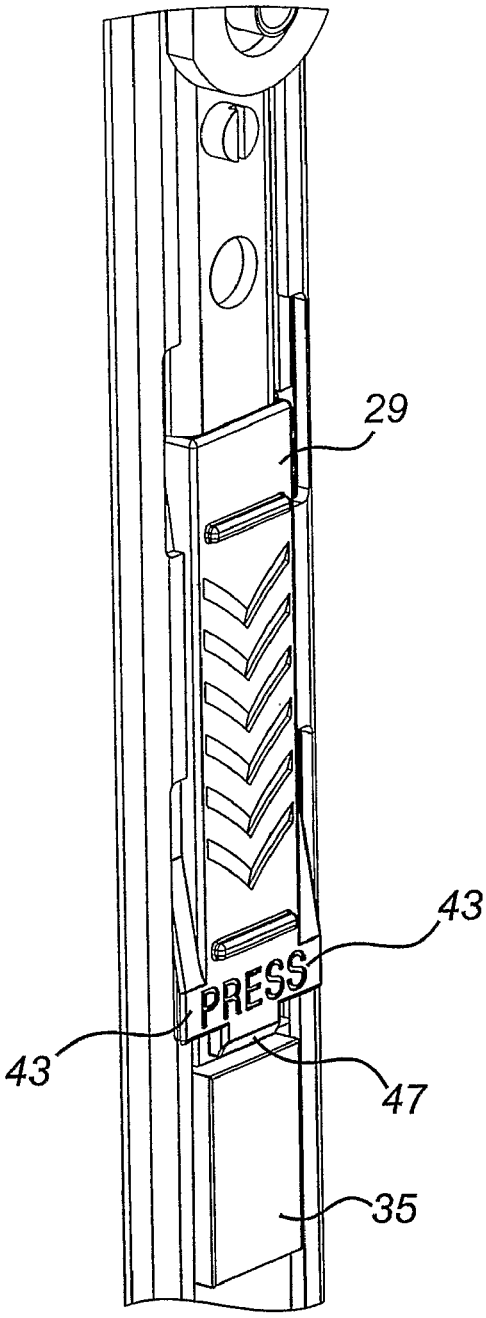
FIG. 3 is a perspective view of the assembled components shown in FIG. 2.
Figure 4:
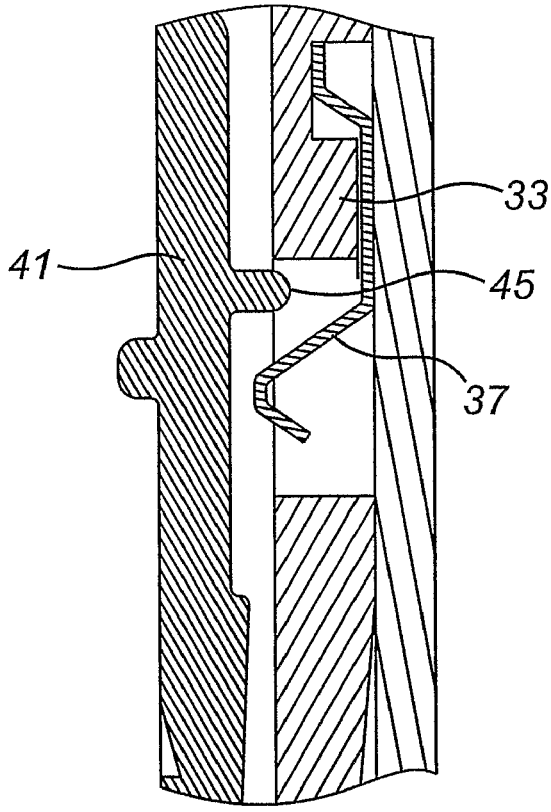
FIG. 4 is a side sectional view showing a part of the slider shown in FIG. 3.

With reference to FIG. 4, a rib 45 is formed on the underneath of the restrictor 41 for interacting with a detent in the form of the spring clip 37 in the cradle 33 of the slider 7. Due to this interaction between the spring clip 37 and the rib 45, the restrictor 41 is held in the cradle 33 adjacent to the body portion 27 of the slider 7. This is shown in FIGS. 3 and 4, and results in the restrictor 41 being biased by the steel spring 39 into its active position with its ears 43 urged upwardly into contact with the flanges 19 of the track 3. Thus, whenever the ears 43 reach the cut-outs 25, the ears will enter the cut outs 25 and prevent further closing of the restricting device 1 due to the flat surfaces of the ears 43 abutting the flanges 19. Thus, the restricting device 1 can only close as far as the first set of cut outs 25 before coming to a halt.

Figure 5:
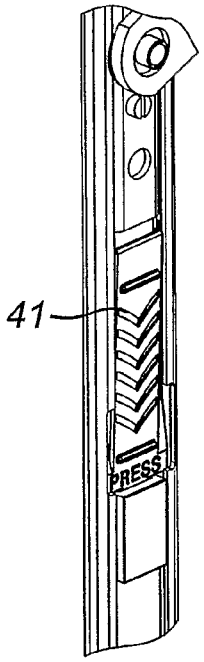
FIG. 5 is a perspective view of the slider of FIG. 3 in which the restrictor is in its inactive position.
Figure 6:
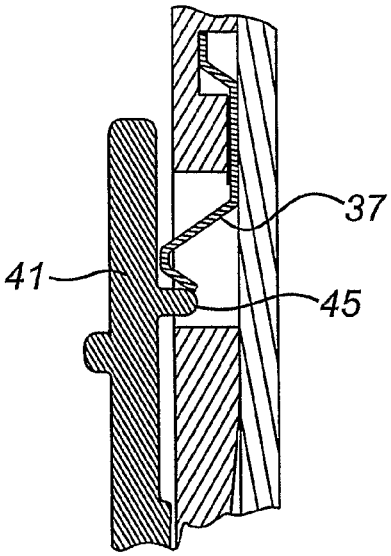
FIG. 6 is a view similar to that of FIG. 4 but showing the location of the restrictor in the slider of FIG. 5.
Figure 7:
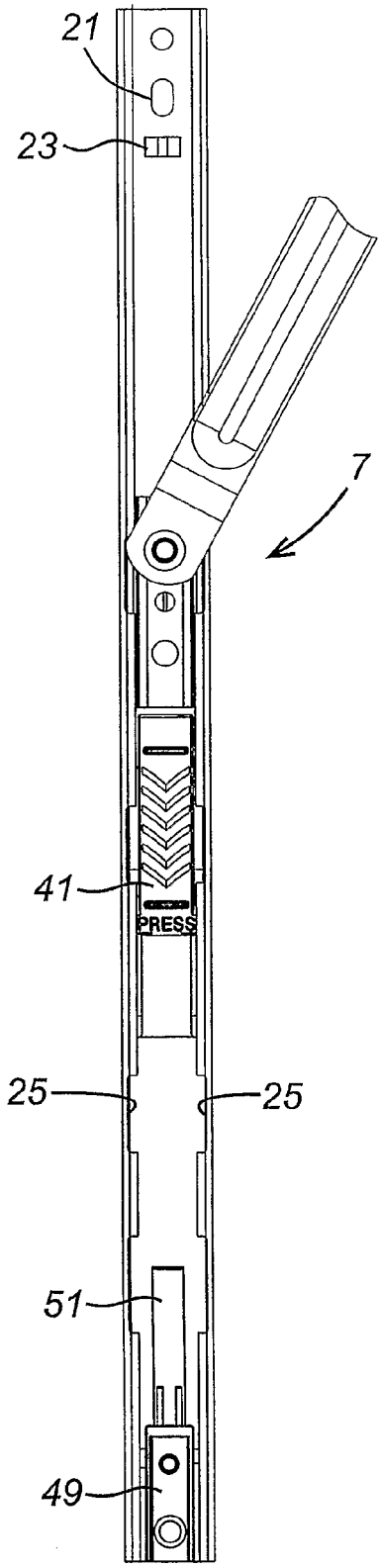
FIG. 7 is a view of the restricting device of FIG. 1 as it moves down the track with the restrictor of the slider in its inactive position.
Figure 8:
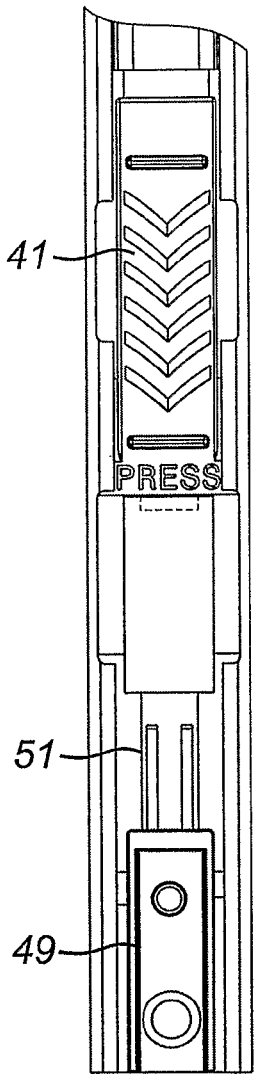
FIG. 8 is a perspective view of the slider of FIG. 7 as it approaches an end stop in the track.
Figure 9:
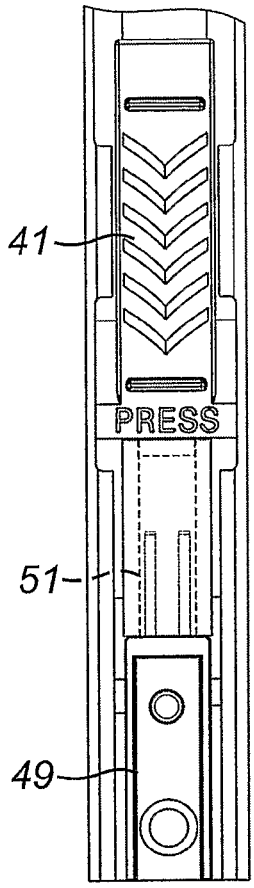
FIG. 9 is a view of the slider of FIG. 8 engaging the end stop.
Figure 11:
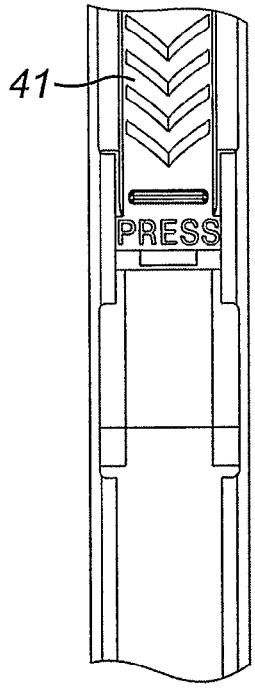
FIG. 11 is a perspective view of the slider with its restrictor in an active position during opening of a window from a closed position.
Figure 10:
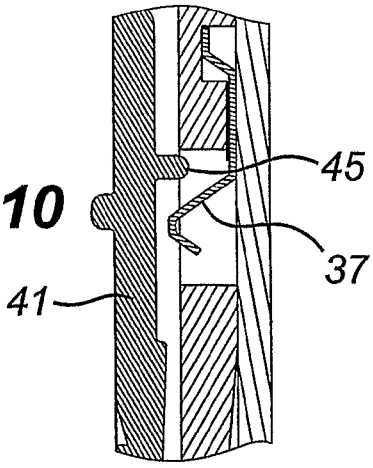
FIG. 10 is essentially the same view as FIG. 4 in which the restrictor has been relocated in its active position in the slider.

To enable the restricting device 1 to be moved further, the end of the restrictor 41 carrying the ears 43 is depressed against the steel spring 39 and urged away from the body portion 27 of the slider such that a tongue 47 enters the channel portion 35. At the same time, the rib 45 passes over the spring clip 37 and the restrictor 41 is thereby held in this position with the ears below the flanges 19 of the track 3 as shown in FIGS. 5, 6 and 7. The slider is then free to move along the track in either direction, thereby allowing the restricting device 1 to be closed fully.

As the slider 7 approaches an end stop 49 fixed to the base 15 of the track 3, a flange 51 of the end stop enters the channel portion 35 of the slider 7 and urges the tongue 47 of the restrictor 41 out of the channel portion 35. When this occurs, the rib 45 passes once again over the spring clip 37 back into its original position and the steel spring 39 once again urges the restrictor 1 to rock and bring the ears 43 into their active position once again. This is shown in FIGS. 8, 9, 10 and 11. In this way, the restrictor 41 is once again in its active position and, as the restricting device 1 is opened, the slider 7 can move along the track 3 passing the cut outs 25 due to the inclined surfaces or ramps formed on the ears 43 of the restrictor 41. The position of the slider 7 can thereby be determined by a user, bearing in mind that the friction between the slider 7 and the track 3 allows the device to be held in a chosen position. If, however, a strong gust of wind blows against the outside of the window sash, the window sash will only be moved a short distance until the ears 43 of the restrictor 41 engage cut outs 25 in the track 3 and prevent further closing of the window. In this way, damage to a window sash and accompanying equipment can be avoided.

It will of course be understood that the present invention has been described above purely by way of example, and that modifications of detail can be made within the scope of the invention as claimed.

The invention claimed is:

1. A slider for use in a track, the slider having a detent fixed therein and further comprising a releasable restrictor having a rib therein, wherein the releasable restrictor is moveable between an active position, wherein the slider is fixedly engageable with the track in a preselected position, and an inactive position, wherein the slider is moveable generally through the track, and wherein the releasable restrictor is received by the slider and engageable with the track, and wherein the releasable restrictor is biased toward the active position by an interaction between the rib and the detent, the releasable restrictor thus automatically resettable from the inactive position to the active position.

2. A slider as claimed in claim 1, wherein the detent comprises a spring clip, wherein interaction between the spring clip and the rib holds the restrictor at a fixed position within the slider.

3. A slider as claimed in claim 1, wherein the rib is disposed on one side of the detent in the active position and disposed on an opposing side of the detent in the inactive position.

4. A slider as claimed in claim 1, further comprising a spring operable with the restrictor, wherein the restrictor is continuously biased against at least a portion of the track by the spring.

5. A slider as claimed in claim 1, wherein the restrictor is adapted to pivot between the active and the inactive positions.

6. A slider as claimed in claim 1, wherein the slider further comprises a cradle, and the restrictor is carried in the cradle and is adapted to move within the cradle between the active and the inactive positions.

7. A slider as claimed in claim 6, wherein the restrictor includes a tongue to retain the restrictor in the inactive position.

8. A slider as claimed in claim 7, wherein the cradle comprises a channel dimensioned to receive the tongue.

9. A slider as claimed in claim 8, further comprising an end stop positionable in the track, wherein the end stop operates to disengage the tongue from the channel to automatically reset the restrictor in the active position.

10. A slider as claimed in claim 9, wherein the end stop comprises an abutment and a flange affixed to the abutment, the flange dimensioned to enter the cradle to engage the tongue.

11. A slider as claimed in claim 1, wherein the restrictor includes means for engaging a the track to restrict motion of the slider along the track.

12. A slider as claimed in claim 11, wherein the engagement means are shaped to restrict motion of the slider in one direction and to allow motion of the slider in the other direction along a track, during use.

13. A slider as claimed in claim 12, wherein the engagement means comprise ears on the restrictor, the ears each having a substantially perpendicular first side and a ramped second side opposite the first side.

14. A restricting device for restricting motion of a window, the device comprising:

a track affixable to a frame of a window;

a slider movably retainable within the track between an active position, wherein the window is generally fixed in a preselected position, and an inactive position, wherein the window is moveable between an open and closed position, the slider comprising a releasable restrictor having a rib thereon, wherein the releasable restrictor is engageable with the slider and is held in the active position by an interaction between the rib and a detent when in a first orientation in the active position, or in the inactive position when the rib and detent are in a second orientation, and wherein the releasable restrictor is resettable to the active position; and a link pivotally affixed to the slider at a first end and to a sash of the window at an opposing second end.

15. A restricting device as claimed in claim 14, wherein the track includes a plurality of cut outs for receiving the restrictor, and wherein the restrictor is in the active position when engaged within the cutouts.

16. A restricting device as claimed in claim 15, wherein the track has a base and two side walls with inwardly facing flanges, the cut outs being formed in the inwardly facing flanges.

17. A restricting device as claimed in claim 14, wherein the device is movable substantially throughout the track when the restrictor is in the inactive position, but held at a restricted position when the restrictor is in the active position.

18. A restricting device for restricting motion of a window sash, the restricting device comprising:

a track having a base and an upstanding side wall having an inwardly facing flange, wherein at least one cut out is formed in the flange;

a slider operable along the track, wherein the slider includes a cradle and a tunnel portion;

a spring clip and a steel spring carried by the cradle;

a restrictor carried by the cradle, wherein the restrictor is pivotable and slidable along the cradle, the restrictor received by the slider and engageable with the track and retained therein by the inwardly facing flange, and wherein the restrictor include an ears for engaging the at least one cut out;

a rib formed with the restrictor for interacting with the spring clip, wherein an interaction between the spring clip and the rib permits the restrictor to be held in the cradle, the restrictor being biased by the steel spring into its active position with the ear urged into contact with the flange, wherein in operation the ear enters the at least one cut out and limits movement of the restricting device, the restricting device thus only moving as far as the cut out before coming to a halt.

19. A device as claimed in claim 18, wherein the ear includes a flat surface which acts to prevent closing of the restricting device and a ramped surface for allowing opening of the restricting device by allowing the ear to move beneath the flange as the slider moves, wherein in operation the ear enters the cut out and prevents further closing of the restricting device, and wherein the flat surface of the ear abuts the flange.

20. A device as claimed in claim 19, wherein enabling the restricting device to be moved further, an end of the restrictor carrying the ear is depressed against the steel spring and urged away from the body portion such that a tongue attached to the restrictor enters the channel portion, wherein at the same time, the rib passes over the spring clip and the restrictor is held in position with the ear below the flange, the slider then being free to move along the track, thereby allowing the restricting device to be fully movable between closed or opened positions.

21. A device as claimed in claim 20, further comprising an end stop fixed to the base, wherein as the slider approaches the end stop, a portion of the end stop enters the channel portion and urges the tongue out of the channel portion, the rib passing over the spring clip and the steel spring urging the restrictor to rock and bring the ear into the active position, the restrictor thus in the active position and the slider movable along the track passing the cut outs resulting from engagement with the ramp surface on the ear.

* * * * *